US011208828B2

(12) United States Patent
Hermans

(10) Patent No.: US 11,208,828 B2
(45) Date of Patent: Dec. 28, 2021

(54) TENT PEG

(71) Applicant: Johnny Christiaan Martin Hermans, JJ Eygelshoven (NL)

(72) Inventor: Johnny Christiaan Martin Hermans, JJ Eygelshoven (NL)

( * ) Notice: Subject to any disclaimer, the term of this patent is extended or adjusted under 35 U.S.C. 154(b) by 0 days.

(21) Appl. No.: 16/769,778

(22) PCT Filed: Nov. 30, 2018

(86) PCT No.: PCT/NL2018/050803
§ 371 (c)(1),
(2) Date: Jun. 4, 2020

(87) PCT Pub. No.: WO2019/112422
PCT Pub. Date: Jun. 13, 2019

(65) Prior Publication Data

US 2020/0299991 A1 Sep. 24, 2020

(30) Foreign Application Priority Data

Dec. 4, 2017 (NL) ..... 2020008

(51) Int. Cl.
*E04H 15/62* (2006.01)

(52) U.S. Cl.
CPC ..... *E04H 15/62* (2013.01)

(58) Field of Classification Search
CPC ..... E04H 15/62
USPC ..... 135/118
See application file for complete search history.

(56) References Cited

U.S. PATENT DOCUMENTS 362,183 A * 5/1887 Runyon ..... E02D 5/803 52/162
1,008,323 A * 11/1911 Gillespie ..... E02D 5/803 52/162
1,034,109 A * 7/1912 Caddy ..... E02D 5/80 52/155
1,189,787 A * 7/1916 Harrison ..... E02D 5/803 52/160
3,974,604 A * 8/1976 Conn ..... E02D 5/805 52/160

(Continued)

FOREIGN PATENT DOCUMENTS

DE 2002329 A1 * 7/1971 ..... E02D 5/803
GB 1279133 A 6/1972
WO WO-2014035000 A1 * 3/2014 ..... E04H 15/62

OTHER PUBLICATIONS

ISR; European Patent Office, NL; dated May 14, 2019.

*Primary Examiner* — Noah Chandler Hawk
(74) *Attorney, Agent, or Firm* — Patshegen IP LLC; Moshe Pinchas

(57) ABSTRACT

Anchoring means for anchoring a guy line of a tent to the ground are formed by two equally large elongated tent pegs which two are in contact with a main surface and can be moved in longitudinal direction relative to each other. This tent peg is in contact with the ground only with one of its main surfaces and with the other main surface is relatively easily movable over the other tent peg. After the tent peg has been extracted from the ground along the tent peg, the tent peg will be extracted from the ground by further pulling at tent peg. This tent peg is also clear of the ground on a main surface, where the tent peg has just been located and can therefore be pulled out of the ground in a simple manner.

7 Claims, 1 Drawing Sheet

(56) References Cited

U.S. PATENT DOCUMENTS

| | | | | |
|---|---|---|---|---|
| 4,063,567 | A | 12/1977 | Martin et al. | |
| 5,217,194 | A * | 6/1993 | Brownell | A63G 9/00 135/118 |
| 7,163,021 | B1 * | 1/2007 | Matsushita | E04H 15/62 135/118 |
| 9,822,546 | B1 * | 11/2017 | Durham | E04H 15/62 |
| 2014/0261598 | A1 * | 9/2014 | Esarey | E04H 15/62 135/118 |
| 2020/0256084 | A1 * | 8/2020 | DeGidio | E04H 15/62 |

* cited by examiner

TENT PEG

TECHNICAL FIELD OF THE INVENTION

The invention relates to anchoring means for anchoring a guy line of a tent to the ground, comprising an elongated tent peg having two main surfaces oppositely disposed on the outside of the tent peg and facing away from each other, and a pointed ground end and an extraction end, which tent peg at the location of or near the extraction end is provided with coupling means to which a guy line can be attached, which anchoring means further include an elongated auxiliary element which is provided with two further main surfaces present on the outside of the auxiliary element oppositely disposed and facing away from each other, which auxiliary element is parallel to the tent peg and is movably connected to the tent peg in longitudinal direction.

BACKGROUND OF THE INVENTION

Such anchoring means are generally known in the embodiment of a tent peg. A problem with the use of tent pegs is extracting tent pegs from the ground after use. Since the tent peg has been in the ground for a long time, it is often stuck in the ground very firmly. In such a case, it takes a lot of effort to extract the tent peg from the ground. Auxiliary elements are known to exist with which tent pegs can be extracted from the ground without much effort. A disadvantage of this is that this auxiliary element must be taken along and not forgotten and takes up space.

An anchoring means according to the preamble of claim 1 is known from U.S. Pat. No. 7,163,021B1. For extracting these known anchoring means from the ground, the auxiliary element can be extended over half its length and then turned for a quarter of a turn. In this position the auxiliary element functions as a handle with which the tent peg can be extracted from the ground. Also with this well-known tent peg, it takes a lot of effort to extract the tent peg from the ground.

SUMMARY OF THE INVENTION

An object of the invention is to provide anchoring means of the type described in the opening paragraph which can be extracted from the ground with little effort. To this end, the anchoring means according to the invention are characterized in that the auxiliary element's further main surface facing the tent peg is in contact with the tent peg's main surface facing the auxiliary element. For extracting the anchoring means according to the invention from the ground, the auxiliary element is to be pulled at. This auxiliary element is in contact with the ground with only one of its main surfaces and with the other main surface is relatively easy to slide over the main surface of the tent peg. Compared to the known tent peg which during use is in contact with the ground during use with both main surfaces and is thus retained by both main surfaces, the auxiliary element is in contact with the ground with only one of the main surfaces, as a result of which it is less firmly retained by the ground. After the auxiliary element has been extracted from the ground along the tent peg up to a stop on the tent peg, the tent peg will be pulled out of the ground on further extraction. The tent peg is clear of the ground on a main surface where the auxiliary element has just been located and is therefore not retained by the ground on both main surfaces, making it easier to extract the peg from the ground than the known tent peg.

An embodiment of the anchoring means according to the invention is characterized in that in at least one of the parts formed by the tent peg and the auxiliary element, there is provided an elongated slot extending in longitudinal direction of the part through which slot a guiding element is projected which is attached to the other one of the two parts.

A further embodiment of the anchoring means according to the invention is characterized in that the main surface and further main surface which are in contact with each other are movable relative to each other between an insertion position, in which the two surfaces are in contact with each other over a first surface, and an extraction position, in which the surfaces are in contact with each other over a second surface, the first surface being larger than the second surface.

Preferably, the first surface is at least substantially equal to the complete surface of the main surface that is in contact with the auxiliary element. Furthermore, the auxiliary element is preferably formed by a further tent peg. The tent peg and the further tent peg are preferably equal to each other.

The main surfaces and further main surfaces are preferably curved in width. The coupling means are preferably formed by a hooked part of the tent peg at the location of the extraction end.

BRIEF DESCRIPTION OF THE DRAWINGS

The invention will be further elucidated hereinbelow with reference to an example of embodiment of the anchoring means according to the present invention shown in the drawings, in which.

DETAILED DESCRIPTION OF THE DRAWINGS

Figure 1:
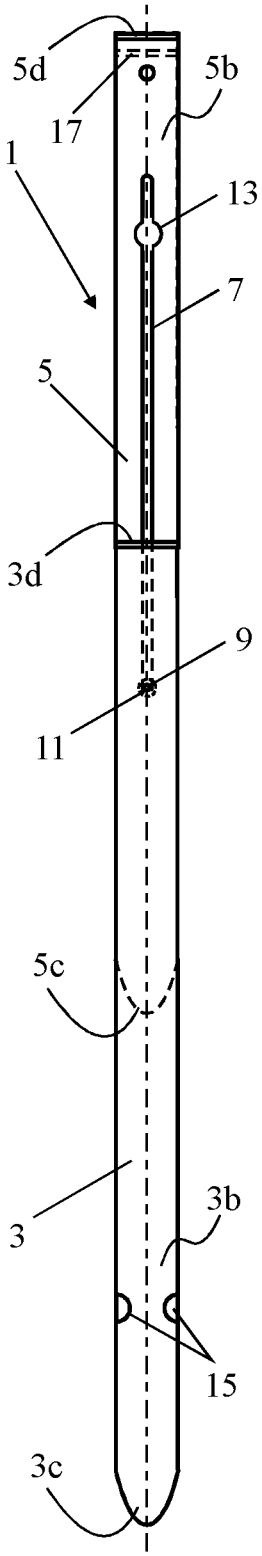
FIG. 1 shows a rear view of an embodiment of the anchoring means according to the invention in extractable position.

FIGS. 1-4 show different views of an embodiment of the anchoring means according to the invention in extractable positions. The anchoring means are formed by two equally large elongated tent pegs 3, 5 which are parallel to each other. One of these tent pegs 5 forms the auxiliary element mentioned above. The tent pegs are elongated and are each provided with two main surfaces 3*a*, 3*b* and 5*a*, 5*b* facing away from each other and a pointed insertion end 3*c*, 5*c* and a perpendicularly hooked extraction end 3*d*, 5*d*, a guy line can be hooked on and which thus forms the coupling means. The tent pegs are in contact with each other via a main surface 3*a*, 5*b* and can slide relative to each other in longitudinal direction. The two tent pegs are curved in width so that they cannot be turned relative to each other.

The tent peg 5 forming the auxiliary element has an elongated slot 7 extending in longitudinal direction of the tent peg, the ends of which slot are spaced apart from the ends of the tent peg and through which slot a guiding element 9 is located, which is attached to the other tent peg 3. This guiding element 9 is formed by a pin which protrudes through the slot and is provided at the end with a head 11 having a diameter that exceeds the width of the slot and holds the two tent pegs against each other.

For separating the two tent pegs 3 and 5, which is desirable for cleaning purposes, the slot 7 locally has a widening 13 through which the head 11 can be projected. At a distance from the insertion end 3*c* of the tent peg 3 are located hooked lips 15 which enclose the other tent peg 5 in retracted position.

Figure 2:
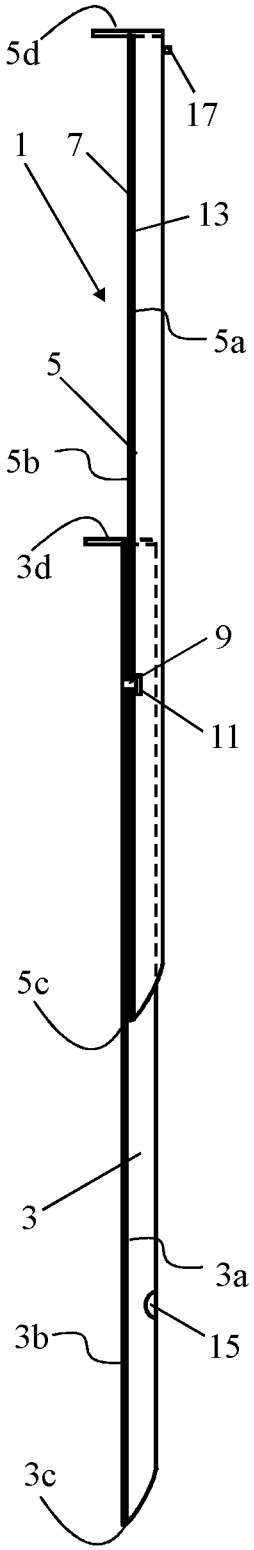
FIG. 2 shows a side view of the anchoring means in extractable position.
Figure 3:
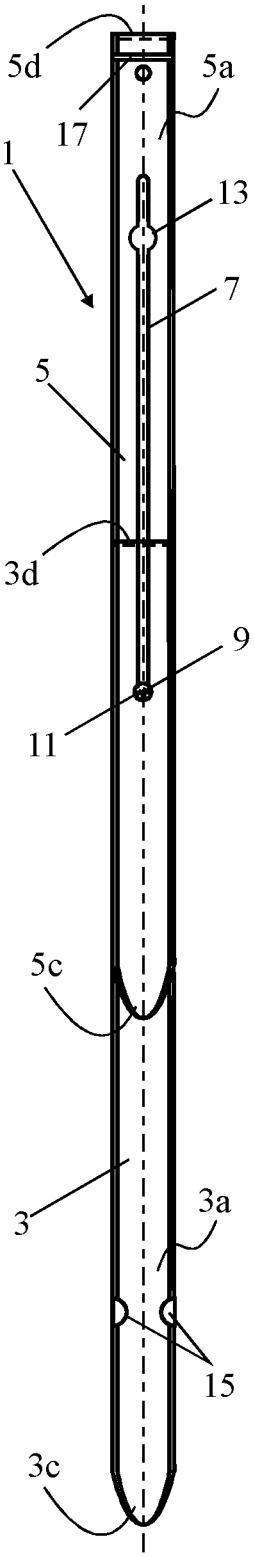
FIG. 3 shows a front view of the anchoring means in extractable position.
Figure 4:
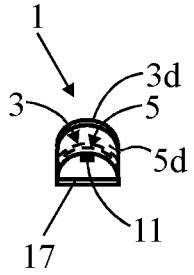
FIG. 4 shows a plan view of the anchoring means.
Figure 5:
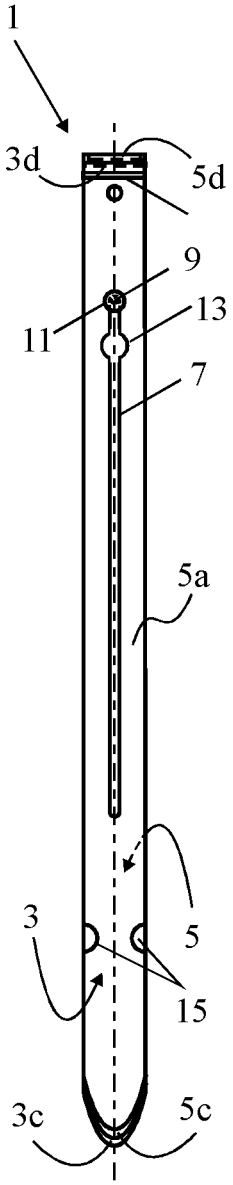
FIG. 5 shows a front view of an embodiment of the anchoring means according to the invention in a retracted position.

In extracted position, the tent pegs 3 and 5 are maximally moved apart and in the retracted position the tent pegs are pushed together as far as possible. The latter position is shown in FIG. 5. The main surfaces 3*a* and 5*b* which are in contact with each other are movable relative to each other between an insertion position, in which both main surfaces are in contact with each other over their entire surface (FIG. 5), and an extracted position, in which the surfaces are in contact with each other over a small part of their surface (FIGS. 1-3).

When the tent pegs are inserted into the ground, the two tent pegs 3 and 5 are completely pushed together and can be inserted into the ground by beating with a hammer on the hooked ends 3*d*, 5*d*.

For extracting the tent pegs 3 and 5 from the ground, the tent peg 5 must be pulled. For having a firm grip on the tent peg 5 so as to pull it without also pulling tent peg 3, a rope or cable can be attached to the extraction end 5*d* of tent peg 5 or it can be ensured that in retracted position the hooked ends 3*d* and 5*d* of the tent pegs 3 and 5 are present at a small distance from each other. In this embodiment, for the purpose of extracting the anchoring means, the tent peg 5 is provided with a rod 17 which forms a bridge between the side edges of the tent peg curved in width. An extraction hook may thus be easily hooked behind this rod. The tent peg 5 is in contact with the ground only with one of its main surfaces 5*a* and is relatively easily slidable with the other main surface 5*b* over the main surface 3*a* of the other tent peg 3. After the tent peg 5 has been extracted from the ground along the tent peg 3 up to the maximum spaced-apart position, the tent peg 3 will be extracted from the ground when the tent peg 5 is further pulled at. This tent peg 3 is also clear of the ground at a main surface 3*b* where the tent peg 5 has just been located and is therefore not retained on both main surfaces by the ground, so that it can also be pulled out of the ground in a simple manner.

Although the present invention has been elucidated above on the basis of the drawings, it should be noted that the invention is not limited in any way to the embodiment shown in the drawings. The invention also extends to any embodiments deviating from the embodiment shown in the drawings within the scope defined by the claims.

The invention claimed is:

1. Anchoring means for anchoring a guy line of a tent to the ground, comprising an elongated tent peg having two main surfaces oppositely disposed on the outside of the tent peg and facing away from each other and a pointed ground end and an extraction end, which tent peg at the location of or near the extraction end is provided with coupling means to which a guy line can be attached, which anchoring means further include an elongated auxiliary element which is provided with two further main surfaces present on the outside of the auxiliary element oppositely disposed and facing away from each other, which auxiliary element is parallel to the tent peg and is movably connected to the tent peg in longitudinal direction, wherein the auxiliary element's further main surface facing the tent peg is in contact with the tent peg's main surface facing the auxiliary element, and wherein the main surface and further main surface which are in contact with each other are movable relative to each other between an insertion position, in which the two surfaces are in contact with each other over a first surface, and an extraction position, in which the surfaces are in contact with each other over a second surface, the first surface being larger than the second surface.

2. Anchoring means as claimed in claim 1, wherein in at least one of the parts formed by the tent peg and the auxiliary element there is provided an elongated slot extending in longitudinal direction of the part through which slot a guiding element is projected which is attached to the other one of the two parts.

3. Anchoring means as claimed in claim 1, wherein the first surface is at least substantially equal to the complete surface of the main surface that is in contact with the auxiliary element.

4. Anchoring means as claimed in claim 1, wherein the auxiliary element is formed by a further tent peg.

5. Anchoring means as claimed in claim 4, wherein the tent peg and further tent peg are of similar length and width.

6. Anchoring means as claimed in claim 1, wherein the main surfaces and further main surfaces are curved in width.

7. Anchoring means as claimed in claim 1, wherein the coupling means are formed by a hooked part of the tent peg at the location of the extraction end.

* * * * *